US012416226B2

(12) United States Patent
Sasaki et al.

(10) Patent No.: US 12,416,226 B2
(45) Date of Patent: Sep. 16, 2025

(54) CRUDE OIL EXTRACTION PUMP

(71) Applicant: MITSUBISHI HEAVY INDUSTRIES, LTD., Tokyo (JP)

(72) Inventors: Shuhei Sasaki, Tokyo (JP); Kimihiko Mitsuda, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/275,051

(22) PCT Filed: Feb. 8, 2021

(86) PCT No.: PCT/JP2021/004649
§ 371 (c)(1),
(2) Date: Jul. 31, 2023

(87) PCT Pub. No.: WO2022/168322
PCT Pub. Date: Aug. 11, 2022

(65) Prior Publication Data
US 2024/0125217 A1 Apr. 18, 2024

(51) Int. Cl.
*E21B 43/12* (2006.01)
*F04D 13/10* (2006.01)
(Continued)

(52) U.S. Cl.
CPC ..... *E21B 43/128* (2013.01); *F04D 13/10* (2013.01); *F04D 29/2266* (2013.01); *F04D 29/041* (2013.01)

(58) Field of Classification Search
CPC .... F04D 13/10; F04D 29/2266; F04D 29/041; E21B 43/121; E21B 43/128
See application file for complete search history.

(56) References Cited

U.S. PATENT DOCUMENTS

2018/0045213 A1 2/2018 Groppo et al.
2018/0298910 A1* 10/2018 Watson ..... F04D 13/10
(Continued)

FOREIGN PATENT DOCUMENTS

JP 2018-508701 A 3/2018

OTHER PUBLICATIONS

International Search Report dated Apr. 6, 2023, issued in counterpart application No. PCT/JP2021/004649, with English translation. (4 pages).

(Continued)

*Primary Examiner* — Kristyn A Hall
(74) *Attorney, Agent, or Firm* — WHDA, LLP

(57) ABSTRACT

A crude oil extraction pump includes: a production pipe having a tubular shape along an axis extending in a vertical direction; a pump rotor extending in a direction of the axis inside the production pipe; and a pump stator which is provided between the production pipe and the pump rotor to surround the pump rotor, wherein the pump rotor includes a plurality of pump shafts which are sequentially connected in the direction of the axis, an impeller which rotates together with the pump shaft to pump crude oil upward, and a thrust collar which protruding radially outward from the pump shaft, and wherein the pump stator includes a tubular stator body and a thrust pad protruding radially inward from an inner peripheral surface of the stator body and supporting the thrust collar from below to be slidable in the circumferential direction.

6 Claims, 5 Drawing Sheets

(51) Int. Cl.
*F04D 29/041* (2006.01)
*F04D 29/22* (2006.01)

(56) References Cited

U.S. PATENT DOCUMENTS

| | | | | |
|---|---|---|---|---|
| 2019/0048695 | A1* | 2/2019 | Hansen | E21B 43/121 |
| 2020/0248695 | A1* | 8/2020 | Xiao | F04D 29/041 |
| 2022/0205452 | A1* | 6/2022 | Mitsuda | F04D 13/08 |

OTHER PUBLICATIONS

Written Opinion dated Apr. 6, 2023, issued in counterpart application No. PCT/JP2021/004649, with English Translation. (6 pages).
International Search Report dated Apr. 6, 2021, issued in counterpart application No. PCTJP2021/004649, with English translation. (4 pages).
Written Opinion dated Apr. 6, 2021, issued in counterpart application No. PCT/JP2021/004649, with English Translation. (6 pages).

* cited by examiner

CRUDE OIL EXTRACTION PUMP

TECHNICAL FIELD

The present disclosure relates to a crude oil extraction pump.

BACKGROUND ART

A pump called an electrical submersible pump (ESP) has been widely used as a device for pumping up crude oil from an oil well. As shown in Patent Document 1 below, a pump includes a rotation shaft which rotates around a rotation axis, a plurality of impellers which are integrally provided with this rotation shaft, and a casing which covers the rotation shaft and the impellers from an outer peripheral side. This pump is disposed in a pipe inserted into a well (oil well) and the rotation shaft is rotated by an electric motor to pump underground oil upwards.

Here, in recent years, pumps using canned motors as electric rotating machines have been proposed for the purpose of improving maintainability and making equipment more compact. This type of pump includes a production pipe which is inserted into an oil well, a motor rotor which is disposed inside the production pipe, a motor stator which is integrally provided on an inner peripheral side of the production pipe, a pump rotor which is integrally provided above the motor rotor, a pump stator which covers this pump rotor from an outer peripheral side and forms a flow path allowing crude oil to flow therethrough, and a thrust bearing portion which rotatably supports the pump rotor with respect to the production pipe. The motor stator includes a coil and a magnet is provided on an outer peripheral surface of the motor rotor facing the motor stator. By energizing the coil, the motor rotor and the pump rotor are rotated by an electromagnetic force. Accordingly, crude oil is sucked up from a lower end of the pump.

CITATION LIST

Patent Document(s)

Patent Document 1: Japanese Patent Application National Publication (Laid-Open) No. 2018-508701

SUMMARY OF INVENTION

Technical Problem

Incidentally, in the above-described pump, the thrust bearing portion is inevitably exposed to the crude oil. Since slurry is mixed with the crude oil, the wear of the sliding portion will be accelerated if slurry flows into the thrust bearing portion. As a result, there is concern that the stable operation of the pump is hindered.

The present disclosure has been made in view of the above-described problems and an object is to provide a crude oil extraction pump that can be operated more stably.

Solution to Problem

In order to solve the above-described problems, a crude oil extraction pump according to the present disclosure includes: a production pipe having a tubular shape along an axis extending in a vertical direction; a pump rotor extending in a direction of the axis inside the production pipe; and a pump stator which is provided between the production pipe and the pump rotor to surround the pump rotor, wherein the pump rotor includes a plurality of pump shafts which are sequentially connected in the direction of the axis, an impeller which is provided in multiple stages in each of these pump shafts and rotated together with the pump shaft to pump crude oil upward, and a thrust collar which is provided in each pump shaft and protruding radially outward, and wherein the pump stator includes a stator body having a tubular shape extending along the axis and a first thrust pad protruding radially inward in the axis from an inner peripheral surface of the stator body and supporting the thrust collar from below to be slidable in the circumferential direction.

Advantageous Effects of Invention

According to the present disclosure, it is possible to provide a crude oil extraction pump that can be operated more stably.

DESCRIPTION OF EMBODIMENTS

First Embodiment

Figure 1:
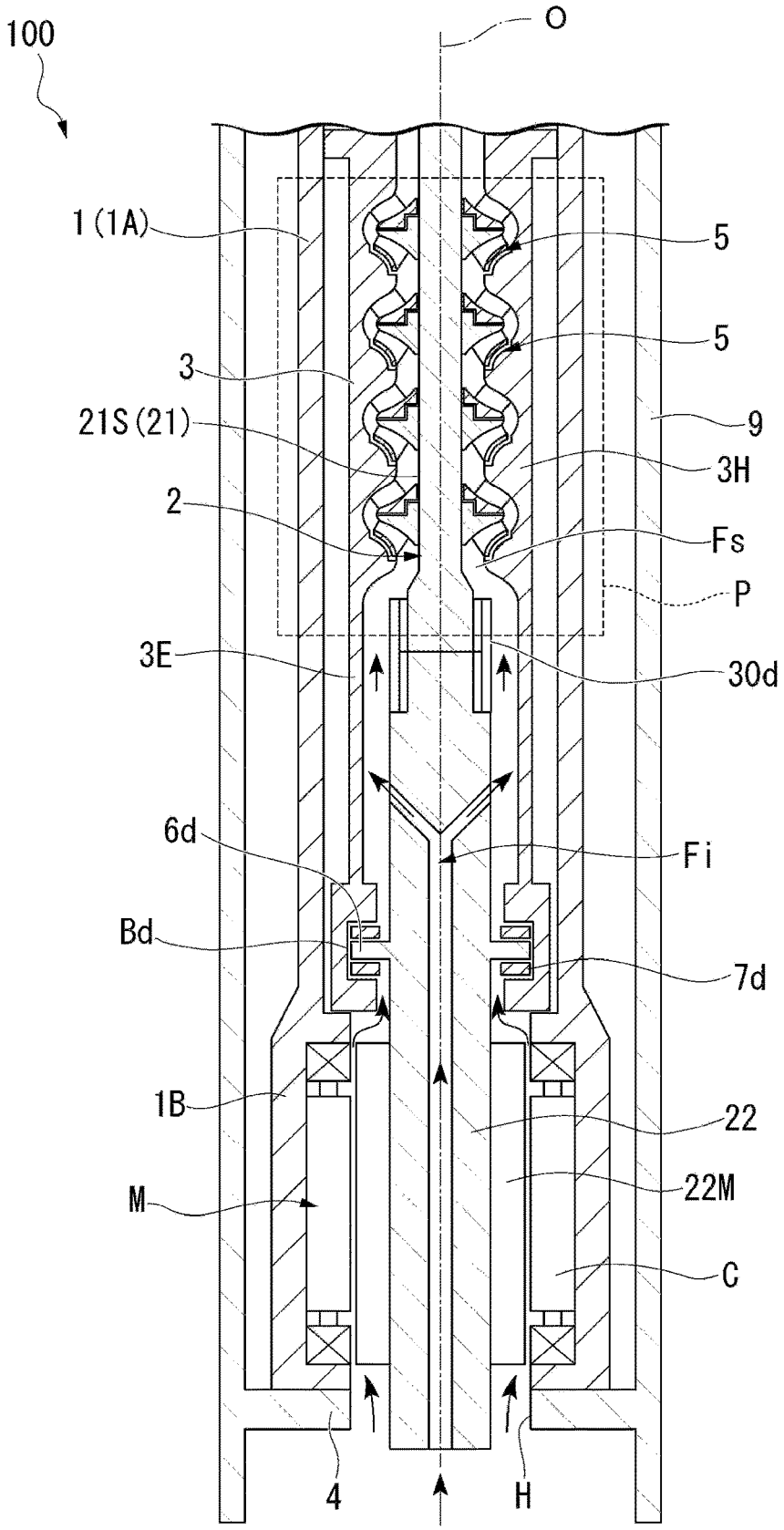
FIG. 1 is a longitudinal sectional view showing a configuration of a crude oil extraction pump according to a first embodiment of the present disclosure.
Figure 2:
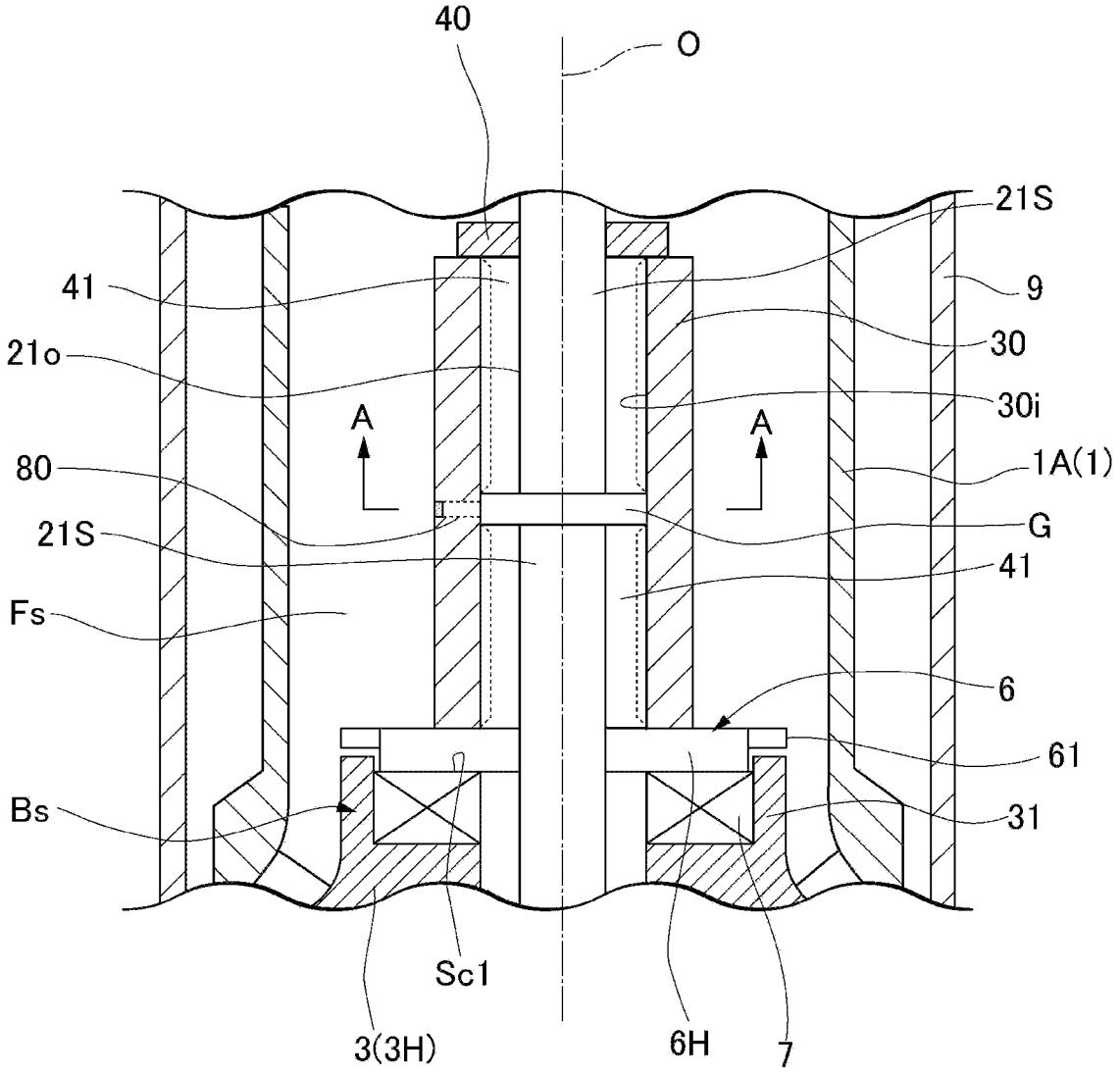
FIG. 2 is a diagram showing a configuration of a connection part of a pump shaft according to the first embodiment of the present disclosure.

Hereinafter, a crude oil extraction pump according to a first embodiment of the present disclosure will be described with reference to FIGS. 1 to 5. A crude oil extraction pump 100 according to this embodiment is a device for pumping up crude oil from an oil well. As shown in FIGS. 1 and 2, this crude oil extraction pump 100 includes a pump body P, a motor M, a drilling pipe 9, a lower end thrust bearing portion Bd, and an intermediate thrust bearing portion Bs. The pump body P is driven by power supplied from the motor M. The drilling pipe 9 covers the pump body P, the motor M, the lower end thrust bearing portion Bd, and the intermediate thrust bearing portion Bs from the outer peripheral side and has a tubular shape centered on an axis extending in the vertical direction.

The pump body P includes a production pipe body 1A, a pump rotor 21, and a pump stator 3. The production pipe body 1A is a tubular member that is coaxial with the drilling pipe 9 and is disposed on the inner peripheral side of the drilling pipe 9. The pump rotor 21 includes a plurality of pump shafts 21S which are connected in the direction of the axis O, a coupling sleeve 30 (see FIG. 2) which connects the pump shafts 21S, and a plurality of impellers 5 which are fixed to these pump shafts 21S.

As shown in FIG. 2, a pair of adjacent pump shafts 21S face each other in the vertical direction (the direction of the axis O) with a gap G therebetween. A tubular fitting member 41 is fitted to each shaft end. These fitting members 41 are covered with a coupling sleeve 30 from the outer peripheral side. The coupling sleeve 30 is a spline coupling for connecting the fitting members 41 by spline-fitting and a plurality of key grooves extending in the direction of the axis O are formed on the inner peripheral surface (sleeve inner peripheral surface 30*i*) at intervals in the circumferential direction. A plurality of linear protrusions that engage with the key grooves are formed on the outer peripheral surface of the fitting member 41. Accordingly, a pair of adjacent pump shafts 21S is rotatable together around the axis O. Further, a gap between the fitting member 41 and the coupling sleeve 30 is covered with a cover member 40 from above.

As shown in FIG. 1, the pump stator 3 includes a stator body 3H which covers the impeller 5 from the outer peripheral side and a stator extension portion 3E. The stator body 3H repeats expansion and contraction in diameter from below to above to accommodate the impeller 5 and defines a stator flow path Fs through which the crude oil flows. The configuration of the impeller 5 and the pump stator 3 will be described later. The stator extension portion 3E is integrally provided with the lower side of the stator body 3H and has a tubular shape centered on the axis O. A lower end thrust pad 7*d* to be described later is attached to the lower end of the stator extension portion 3E.

As shown in FIG. 1, the motor M includes a production pipe tip 1, a motor rotor 22, a coil C, and a magnetic member 22M. The production pipe tip 1B has a tubular shape and is integrally provided below the production pipe body 1A. The production pipe body 1A and the production pipe tip 1B form the production pipe 1 as a whole. The inner peripheral surface of the production pipe tip 1B is provided with a plurality of coils C arranged in the circumferential direction. This coil C generates an electromagnetic force by a current supplied from the outside. The motor rotor 22 is disposed on the inner peripheral side of these coils C and has a columnar shape extending along the axis O. The motor rotor 22 is connected to a pump shaft 21S located at the lowest position among a plurality of pump shafts 21S constituting the above-described pump rotor 21 through a lower end spline coupling 30*d*. The plurality of pump shafts 21S and the motor rotor 22 form the rotor 2 as a whole. A permanent magnet is provided on the outer peripheral surface of the motor rotor 22 as the magnetic member 22M. A rotational force is applied to the rotor 2 by an electromagnetic force generated between a magnetic field generated by energizing the coil C and a magnetic field of the magnetic member 22M.

Additionally, the production pipe tip 1B is supported from below by an annular support portion 4 that protrudes radially inward from the inner peripheral surface of the drilling pipe 9. An opening on the inner peripheral side of the support portion 4 is formed as an opening portion H for taking in crude oil. The lower end of the motor rotor 22 is inserted through this opening portion H. A suction flow path Fi for sucking crude oil is formed inside the motor rotor 22 in addition to the opening portion H. This suction flow path Fi communicates with the stator flow path Fs formed on the inner peripheral side of the pump stator 3.

Further, a lower end thrust collar 6*d* is provided on the outer peripheral surface of the motor rotor 22 and above the magnetic member 22M to protrude radially outward and have an annular shape centered on the axis O. This lower end thrust collar 6*d* is supported from above and below by the lower end thrust pad 7*d* provided on the inner peripheral surface of the pump stator 3 (stator extension portion 3E). The lower end thrust collar 6*d* and the lower end thrust pad 7*d* form the lower end thrust bearing portion Bd. The rotor 2 (the pump rotor 21 and the motor rotor 22) is supported by the lower end thrust bearing portion Bd and the intermediate thrust bearing portion Bs to be described later to be rotatable about the axis O with respect to the pump stator 3.

Figure 3:
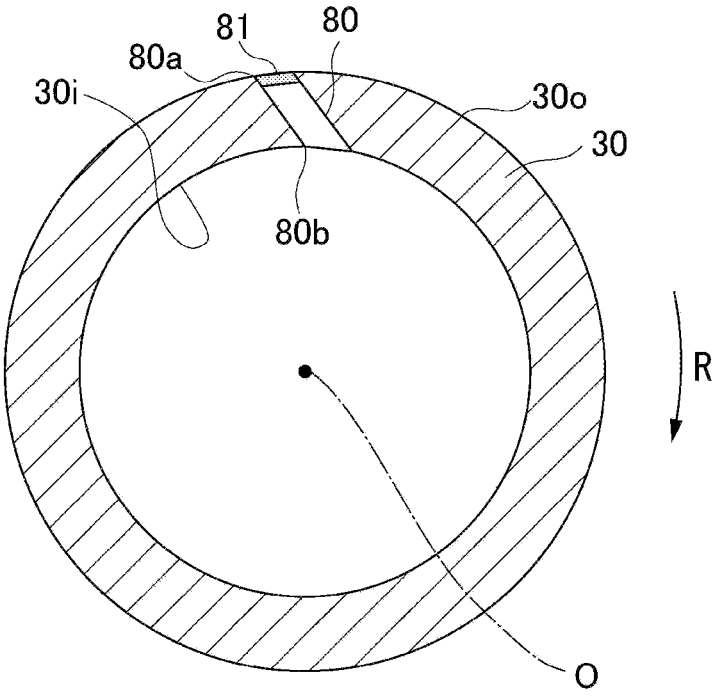
FIG. 3 is a cross-sectional view taken along a line A-A of FIG. 2.
Figure 4:
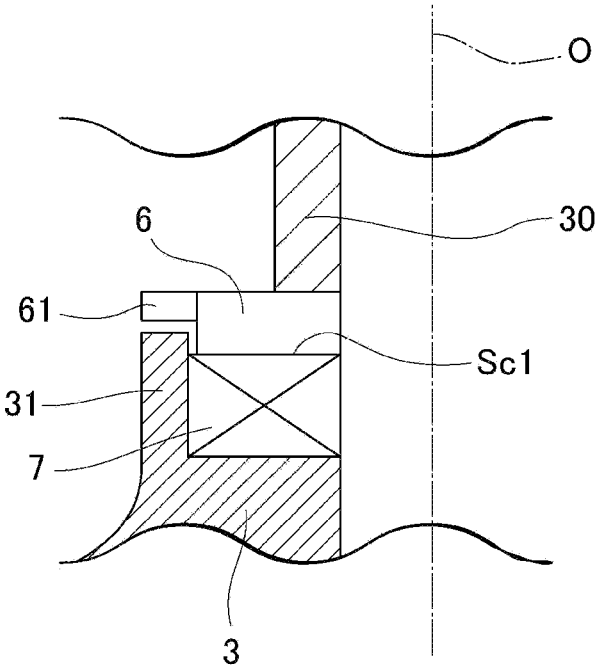
FIG. 4 is a diagram showing a configuration of a thrust bearing according to the first embodiment of the present disclosure.

Next, the configuration of the connection part of the pump shaft 21S and the configuration of the intermediate thrust bearing portion Bs will be described with reference to FIGS. 2 and 3. As shown in FIG. 2, the shaft ends of the pair of adjacent pump shafts 21S face each other through a gap G spreading in the vertical direction and are covered with the coupling sleeve 30 through the fitting member 41 from the outer peripheral side. The coupling sleeve 30 is provided with a through-hole 80 which allows the gap G to communicate with the outer peripheral stator flow path Fs. More specifically, as shown in FIG. 3, the through-hole 80 is formed in the coupling sleeve 30 in the circumferential direction. The through-hole 80 extends toward the rear side of the rotor 2 in the rotation direction R as it goes from the inner radial end portion (outlet 80*b*) toward the outer radial end portion (inlet 80*a*). Further, the inlet 80*a* is provided with a capture portion 81 for capturing slurry contained in the crude oil. As the capture portion 81, a metallic mesh is appropriately used. This capture portion 81 regulates the passage of the slurry while allowing the passage of the liquid phase components of the crude oil excluding the slurry.

Further, as shown in FIG. 2, the intermediate thrust bearing portion Bs is provided below the coupling sleeve 30. One intermediate thrust bearing portion Bs is provided for each pump shaft 21S. The intermediate thrust bearing portion Bs includes an intermediate thrust collar 6 (thrust collar) which is provided on the outer peripheral surface (shaft outer peripheral surface 21*o*) of the pump shaft 21S and an intermediate thrust pad 7 (thrust pad) which is fixed to the pump stator 3.

The intermediate thrust collar 6 includes a thrust collar body 6H which protrudes radially outward from the shaft outer peripheral surface 21*o* and has an annular shape centered on the axis O and a second protruding portion 61 which is provided on the outer peripheral end surface of the thrust collar body 6H. The second protruding portion 61 protrudes radially outward from the outer peripheral surface of the thrust collar body 6H to have an annular shape centered on the axis O. The dimension of the second protruding portion 61 in the direction of the axis O is smaller than the dimension of the thrust collar body 6H in the direction of the axis O.

The intermediate thrust pad 7 is fixed to the upper end portion of the pump stator 3 (stator body 3H). An upward facing surface of the intermediate thrust pad 7 is a sliding surface Sc1 which slides on the lower surface of the thrust collar body 6H. The pump stator 3 is provided with a first protruding portion 31 which protrudes upward to cover the sliding surface Sc1 from the outer peripheral side (see FIG. 2 or 4). That is, the dimension of the first protruding portion 31 in the direction of the axis O is set to be larger than the dimension of the intermediate thrust pad 7 in the direction of the axis O. Further, the upper end of the first protruding portion 31 faces the above-described second protruding portion 61 from below. A slight gap is formed between the first protruding portion 31 and the second protruding portion 61 in the direction of the axis O. Further, a slight radially expanding gap is formed between the first protruding portion 31 and the thrust collar body 6H.

Figure 5:
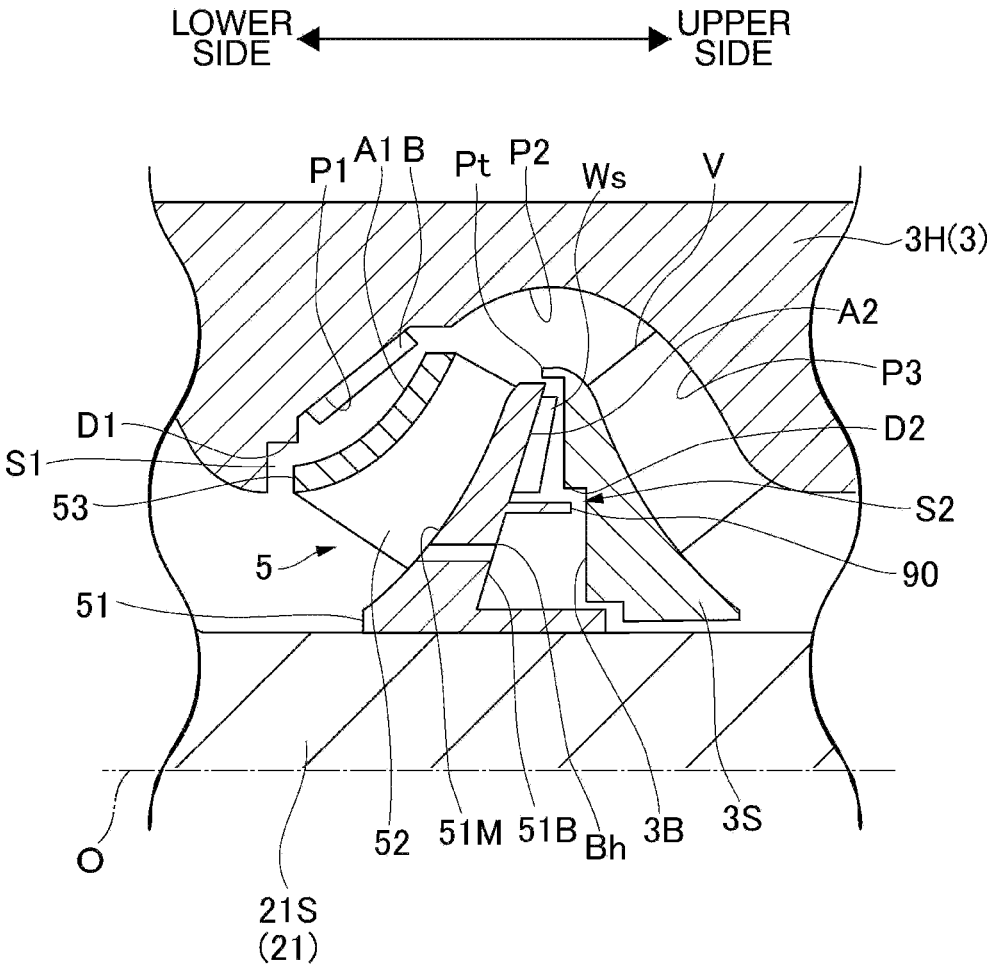
FIG. 5 is a diagram showing a configuration of an impeller according to the first embodiment of the present disclosure.

Next, the configuration of the impeller 5 will be described with reference to FIG. 5. The impeller 5 includes a disk 51, a blade 52, and a shroud cover 53. The disk 51 is fixed to the outer peripheral surface of the pump shaft 21S and has a disk shape centered on the axis O. A downward facing surface of the disk 51 is a disk main surface 51M. The disk main surface 51M is curved from the inside to the outside in the radial direction as it goes from below to above.

The disk main surface 51M is provided with a plurality of blades 52 which are arranged at intervals in the circumferential direction. Although not shown in detail, each blade 52 is curved toward the front side of the rotor 2 in the rotation direction as it goes from the inside to the outside in the radial direction. Further, the blade height (the rising dimension from the disk main surface 51M) of the blade 52 gradually decreases from below to above.

The upward facing surface (back surface 51B) of the disk 51 extends in a planar shape from the inside to the outside in the radial direction as it goes from below to above. A turning blade Ws and a partition portion 90 are provided on the back surface 51B in order from the outside to the inside in the radial direction. A plurality of turning blades Ws are provided at intervals in the circumferential direction. Each turning blade Ws has a plate shape extending in the radial direction. The partition portion 90 protrudes upward from the back surface 51B on the radial inside of these turning blades Ws. The partition portion 90 has a cylindrical shape centered on the axis O. A space is formed on the radial inside of the partition portion 90. Further, the disk 51 is provided with a balance hole Bh which penetrates the disk 51 in the direction of the axis O from the disk main surface 51M to the back surface 51B.

The shroud cover 53 has a funnel shape that covers the plurality of blades 52 from below. The shroud cover 53 is curved from the inside to the outside in the radial direction as it goes from below to above.

The impeller 5 with the above-described configuration is covered with the stator body 3H from the outer peripheral side. A surface facing the shroud cover 53 in the inner peripheral surface of the stator body 3H is a facing surface P1. A first stepped portion D1 which covers the lower end of the shroud cover 53 from the direction of the axis O and the radial direction is formed at the lower portion of the facing surface P1. A portion facing the first stepped portion D1 in the shroud cover 53 is a first seal portion S1. Further, a portion above the first stepped portion D1 in the facing surface P1 is provided with a baffle plate B. The baffle plate B protrudes radially inward from the facing surface P1 and has a plate shape extending in the radial direction. A plurality of baffle plates B are provided at intervals in the circumferential direction.

A region adjacent to the upper side of the facing surface P1 in the inner peripheral surface of the stator body 3H is a connection surface P2. The connection surface P2 is recessed radially outward in a curved surface shape. Further, a region adjacent to the upper side of the connection surface P2 is a downstream surface P3. The downstream surface P3 extends from the outside to the inside in the radial direction as it goes from below to above. This downstream surface P3 is provided with the plurality of vanes V and a stator shroud 3S fixed to the inner peripheral side of the vane V. Each vane V has a plate shape that protrudes radially inward from the downstream surface P3. A plurality of vanes V are arranged at intervals in the circumferential direction.

The stator shroud 3S faces the above-described back surface 51B from above. A downward facing surface (stator shroud lower surface 3B) of the stator shroud 3S is provided with a protrusion portion Pt and a second stepped portion D2 in order from the outside to the inside in the radial direction. The protrusion portion Pt protrudes downward to cover the outer radial edge of the disk 51 from the outside in the radial direction through a gap. The second stepped portion D2 covers the partition portion 90 provided on the back surface 51B from the outside in the radial direction. That is, a portion on the radial inside of the second stepped portion D2 in the stator shroud lower surface 3B is recessed upward in relation to the outer radial portion. A second seal portion S2 is formed by the second stepped portion D2 and the partition portion 90.

Here, a region on the radial outside of the first seal portion S1 in the shroud cover 53 is a first region A1. A region on the radial outside of the second seal portion S2 in the back surface 51B is a second region A2. The dimension of each portion is set so that an area (projection area) of the first region A1 when viewed from the direction of the axis O becomes larger than an area (projection area) of the second region A2.

(Operation and Effect)

Next, the operation of the crude oil extraction pump 100 will be described. In order to operate the crude oil extraction pump 100, the rotor 2 is first rotated by supplying electric power to the motor M. When the rotor 2 rotates, the crude oil in the oil well is sucked up by the pump body P from the opening portion H formed at the lower end of the drilling pipe 9. Further, at this time, the crude oil is also sucked up by the suction flow path Fi formed in the motor rotor 22.

Here, in the above-described crude oil extraction pump 100, since the thrust bearing (the lower end thrust bearing portion Bd and the intermediate thrust bearing portion Bs) is exposed to the stator flow path Fs, the crude oil flowing through the flow path is exposed. Since the crude oil contains slurry, the wear of the sliding surface Sc1 will be accelerated if the slurry enters the thrust bearing. As a result, the stable operation of the crude oil extraction pump 100 may be hindered. Here, this embodiment adopts the above-described configuration.

According to the above-described configuration, the pump rotor 21 is formed by connecting the plurality of pump shafts 21S and each pump shaft 21S is provided with the thrust collar 6. Further, the pump stator 3 is provided with the plurality of intermediate thrust pads 7 which respectively support the thrust collars 6 from below. Thus, for example, compared to a configuration in which one thrust collar 6 and one intermediate thrust pad 7 are provided in the rotor 2, the load applied to each of the thrust collar 6 and the intermediate thrust pad 7 is distributed and the load per each intermediate thrust bearing portion Bs can be suppressed to be small. Accordingly, the wear of the thrust collar 6 and the intermediate thrust pad 7 can be reduced.

According to the above-described configuration, the sliding surface Sc1 between the thrust collar 6 and the intermediate thrust pad 7 is covered with the first protruding portion 31 from the outer peripheral side. Further, the first protruding portion 31 is covered with the facing second protruding portion 61 from above. Thus, the sliding surface Sc1 is less likely to be directly exposed to the crude oil flowing on the inner peripheral side of the pump stator 3. As a result, the possibility that the slurry contained in the crude oil flows into the sliding surface Sc1 is reduced and the wear of the thrust collar 6 and the intermediate thrust pad 7 can be suppressed.

According to the above-described configuration, the first area of the first region A1 of the shroud cover 53 which is expanded radially outward with respect to the first seal portion S1 located on the lower side (upstream side) when viewed from the direction of the axis O is larger than the second area of the second region A2 of the back surface 51B which is expanded radially outward with respect to the second seal portion S2 located on the upper side (downstream side). Accordingly, a load is applied to the impeller 5 in a direction from below to above. Thus, the thrust load (the load applied from above to below) to be borne by each thrust collar 6 and each intermediate thrust pad 7 can be suppressed to be small. As a result, the wear of the thrust collar 6 and the intermediate thrust pad 7 can be suppressed.

According to the above-described configuration, since the facing surface P1 is provided with the baffle plate B, the flow velocity of the fluid flowing along the facing surface P1 decreases. Accordingly, the static pressure of the fluid on the side of the shroud cover 53 (that is, the upstream side) increases. Further, since the back surface 51B is provided with the turning blade Ws, the flow velocity of the fluid flowing along the back surface 51B increases. Accordingly, the static pressure of the fluid on the side of the back surface 51B (that is, the downstream side) decreases. As a result, a force is applied to the impeller 5 in a direction from the upstream side to the downstream side (that is, from below to above). Thus, the thrust load (the load applied from above to below) to be borne by each thrust collar 6 and each intermediate thrust pad 7 can be suppressed to be small. As a result, the wear of the thrust collar 6 and the intermediate thrust pad 7 can be suppressed.

According to the above-described configuration, the gap G is formed between the adjacent pump shafts 21S. Since a part of the crude oil flows into the gap G through the through-hole 80, the intermediate pressure can be secured. On the other hand, since the slurry contained in the crude oil is captured by the capture portion 81, the slurry does not flow into the gap G. That is, it is possible to prevent the slurry from flowing between the coupling sleeve 30 and the pump shaft 21S (fitting member 41) through the gap G. As a result, the possibility of the wear occurring between the coupling sleeve 30 and the pump shaft 21S (fitting member 41) can be reduced.

According to the above-described configuration, the gap between the fitting member 41 and the coupling sleeve 30 is covered with the cover member 40 from above. Thus, the possibility that the slurry flows into the gap can be reduced. As a result, the possibility of the wear between the coupling sleeve 30 and the fitting member 41 can be reduced.

According to the above-described configuration, the through-hole 80 extends toward the rear side of the pump shaft 21S in the rotation direction R (that is, the side opposite to the rotation direction R) as it goes from the inside to the outside in the radial direction. Thus, the possibility that the slurry flows into the through-hole 80 with the rotation of the pump shaft 21S can be reduced. As a result, the possibility of the wear occurring between the coupling sleeve 30 and the pump shaft 21S (fitting member 41) can be reduced.

Second Embodiment

Next, a crude oil extraction pump according to a second embodiment of the present disclosure will be described with reference to FIG. 6. Additionally, in the following description, the same symbols are given to the same constituent elements as in the first embodiment, and the description thereof is omitted.

Figure 6:
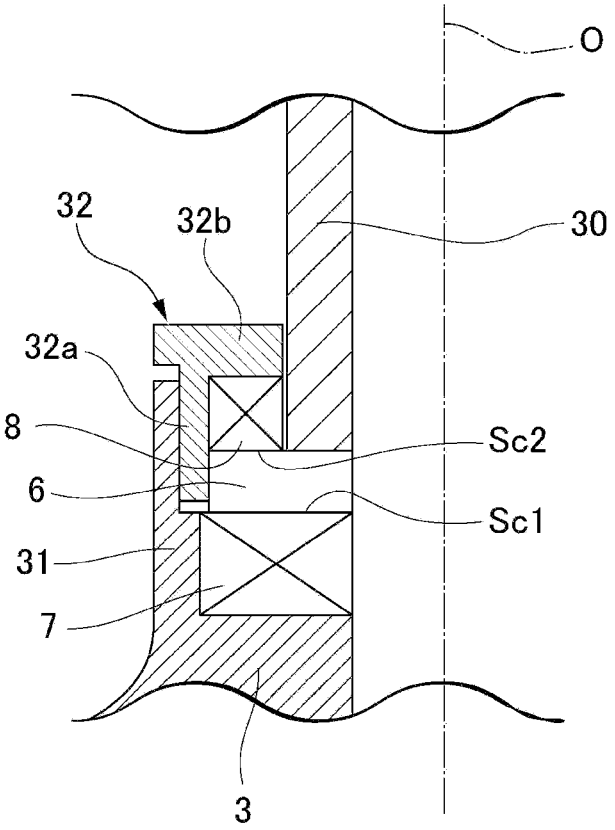
FIG. 6 is a diagram showing a configuration of a thrust bearing according to a second embodiment of the present disclosure.

As shown in FIG. 6, the intermediate thrust bearing portion Bs of this embodiment includes another intermediate thrust pad (second thrust pad) 8 in addition to the intermediate thrust pad 7. The intermediate thrust pad 8 is disposed on the upper portion of the thrust collar 6 and is fixed to the first protruding portion 31 of the pump stator 3 through an added holder 32. The holder 32 includes a tubular portion 32*a* which is formed to cover a sliding surface Sc2 from the outer peripheral side and a flange portion 32*b* which is formed at the upper end of the tubular portion 32*a*. The first protruding portion 31 of the pump stator 3 extends upward compared to the first embodiment and the tubular portion 32*a* of the holder 32 is inserted into the extended first protruding portion 31 and is fixed to the first protruding portion 31 through a fixing means such as a screw. The flange portion 32*b* protrudes radially inward from the upper end of the tubular portion 32*a* to have an annular shape centered on the axis O. The intermediate thrust pad 8 is fixed to the holder 32 so that the outer peripheral surface comes into contact with the inner peripheral surface of the tubular portion 32*a* and the upward facing surface comes into contact with the lower surface of the flange portion 32*b*.

The downward facing surface of the intermediate thrust pad 8 is the sliding surface Sc2 which slides on the upper surface of the thrust collar body 6H. The inner diameter of the intermediate thrust pad 8 is slightly larger than the outer diameter of the coupling sleeve 30 and the inner peripheral surface of the intermediate thrust pad 8 does not contact the coupling sleeve 30. Similarly, the inner diameter of the flange portion 32*b* is slightly larger than the outer diameter of the coupling sleeve 30 and the flange portion 32*b* does not interfere with the coupling sleeve 30.

According to the above-described configuration, since the pump stator 3 is provided with the intermediate thrust pad 8 in addition to the intermediate thrust pad 7 which supports the thrust collar 6 from below, the thrust collar 6 is supported not only from below but also from above. Accordingly, fluctuations of the pump shaft 21S in the direction of the axis O can be suppressed.

According to the above-described configuration, since the sliding surface Sc2 between the thrust collar 6 and the intermediate thrust pad 8 is covered from above with the flange portion 32*b* of the holder 32, it is possible to prevent the slurry contained in the crude oil flowing on the inner peripheral side of the pump stator 3 from flowing into the sliding surface Sc2. Further, since the outer peripheral surface of the thrust collar 6 is covered with the extended first protruding portion 31 and the tubular portion 32*a* of the holder 32 inserted into the first protruding portion 31, it is possible to prevent the slurry from flowing into the outer peripheral surface of the thrust collar 6. As a result, the wear of the thrust collar 6 and the intermediate thrust pads 7 and 8 due to the slurry contained in the crude oil can be suppressed.

As described above, the embodiments of the present disclosure have been described in detail with reference to the drawings, but the specific configuration is not limited to these embodiments, and design changes and the like are included within the scope of the present disclosure.

For example, as the lower end thrust bearing portion Bd and the intermediate thrust bearing portion Bs described in the above-described embodiments, specifically, a parallel plane bearing, an inclined plane bearing, a tapered land bearing, a step bearing, a pocket bearing, a spiral groove bearing, and a herringbone groove bearing can be appropriately selected according to the design and specifications.

APPENDIX

The crude oil extraction pump of each embodiment is understood, for example, as below.

(1) The crude oil extraction pump 100 according to a first aspect includes: the production pipe 1 having a tubular shape along the axis O extending in the vertical direction; the pump rotor 21 extending in a direction of the axis O inside the production pipe 1; and the pump stator 3 which is provided between the production pipe 1 and the pump rotor 21 to surround the pump rotor 21, wherein the pump rotor 21 includes the plurality of pump shafts 21S which are sequentially connected in the direction of the axis O, the impeller 5 which is provided in multiple stages in these pump shafts 21S and rotated together with the pump shaft 21S to pump the crude oil upward, and the thrust collar 6 which is provided in each pump shaft 21S and protruding radially outward, and wherein the pump stator 3 includes the stator body 3H having a tubular shape extending along the axis O and the intermediate thrust pad 7 which protrudes radially inward in the axis O from the inner peripheral surface of the stator body 3H and supporting the thrust collar 6 from below to be slidable in the circumferential direction.

According to the above-described configuration, the pump rotor 21 is formed by connecting the plurality of pump shafts 21S and each pump shaft 21S is provided with the thrust collar 6. Further, the pump stator 3 is provided with the plurality of intermediate thrust pads 7 which respectively support the thrust collars 6 from below. Thus, for example, compared to a configuration in which one thrust collar 6 and one intermediate thrust pad 7 are provided, the load applied to each of the thrust collar 6 and the intermediate thrust pad 7 can be suppressed to be small. Accordingly, the wear of the thrust collar 6 and the intermediate thrust pad 7 can be reduced.

(2) In the crude oil extraction pump 100 according to a second aspect, the pump stator 3 may include the first protruding portion 31 protruding upward to cover the sliding surface Sc1 between the thrust collar 6 and the intermediate thrust pad 7 from the outer peripheral side and the thrust collar 6 may include the second protruding portion 61 protruding radially outward and facing the upper end of the first protruding portion 31 from below.

According to the above-described configuration, the sliding surface Sc1 between the thrust collar 6 and the intermediate thrust pad 7 is covered with the first protruding portion 31 from the outer peripheral side. Further, the first protruding portion 31 is covered with the facing second protruding portion 61 from above. Thus, the sliding surface Sc1 is less likely to be directly exposed to the crude oil flowing on the inner peripheral side of the pump stator 3. As a result, the possibility that the slurry contained in the crude oil flows into the sliding surface Sc1 is reduced and the wear of the thrust collar 6 and the intermediate thrust pad 7 can be suppressed.

(3) In the crude oil extraction pump 100 according to a third aspect, the impeller 5 may include the disk 51 having a disk shape and is fixed to the pump shaft 21S, the blades 52 which are provided on the downward facing surface of the disk 51 at intervals in the circumferential direction, and the shroud cover 53 covering the blade 52 from below, the first seal portion S1 may be formed on the outer peripheral surface of the shroud cover 53 so that a first clearance is formed between the first seal portion and the pump stator 3, the second seal portion s2 may be formed on the back surface 51B of the disk 51 facing upward so that a second clearance is formed between the second seal portion and the pump stator 3, and the first area of the first region A1 of the shroud cover 53 which is expanded radially outward with respect to the first seal portion S1 when viewed from the direction of the axis O may be larger than the second area of the second region A2 of the back surface 51B which is expanded radially outward with respect to the second seal portion S2 when viewed from the direction of the axis O.

According to the above-described configuration, the first area of the first region A1 of the shroud cover 53 which is expanded radially outward with respect to the first seal portion S1 located on the lower side (upstream side) when viewed from the direction of the axis O is larger than the second area of the second region A2 of the back surface 51B which is expanded radially outward with respect to the second seal portion S2 located on the upper side (downstream side). Accordingly, a load is applied to the impeller 5 in a direction from below to above. Thus, the thrust load (the load applied from above to below) to be borne by each thrust collar 6 and each intermediate thrust pad 7 can be suppressed to be small. As a result, the wear of the thrust collar 6 and the intermediate thrust pad 7 can be suppressed.

(4) In the crude oil extraction pump 100 according to a fourth aspect, the pump stator 3 may include the plurality of baffle plates B which are provided at intervals in the circumferential direction on the surface P1 of the pump stator 3 facing the outer peripheral surface of the shroud cover 53 and each extending in the radial direction and the impeller 5 may include the turning blades Ws which are provided on the back surface 51B at intervals in the circumferential direction and each extending in the radial direction.

According to the above-described configuration, since the facing surface P1 is provided with the baffle plate B, the flow velocity of the fluid flowing along the facing surface P1 decreases. Accordingly, the static pressure of the fluid on the side of the shroud cover 53 (that is, the upstream side) increases. Further, since the back surface 51B is provided with the turning blade Ws, the flow velocity of the fluid flowing along the back surface 51B increases. Accordingly, the static pressure of the fluid on the side of the back surface 51B (that is, the downstream side) decreases. As a result, a force is applied to the impeller 5 in a direction from the upstream side to the downstream side (that is, from below to above). Thus, the thrust load (the load applied from above to below) to be borne by each thrust collar 6 and each intermediate thrust pad 7 can be suppressed to be small. As a result, the wear of the thrust collar 6 and the intermediate thrust pad 7 can be suppressed.

(5) In the crude oil extraction pump 100 according to a fifth aspect, the pair of pump shafts 21S adjacent to each other in the vertical direction may be arranged so that an upper end of one of the pump shafts 21S is spaced apart from a lower end of the other, the coupling sleeve 30 may be provided to connect the pair of adjacent pump shafts 21S to cover the outer peripheral of the pump shafts 21S, the coupling sleeve 30 may be provided with the through-hole 80 penetrating the coupling sleeve 30 in the radial direction and opens to the gap G of the pair of pump shafts 21S, and the capture portion 81 for capturing the slurry in the crude oil may be provided in a part of the through-hole 80.

According to the above-described configuration, the gap G is formed between the adjacent pump shafts 21S. Since a part of the crude oil flows into the gap G through the through-hole 80, the intermediate pressure can be secured. On the other hand, since the slurry contained in the crude oil is captured by the capture portion 81, the slurry does not flow into the gap G. That is, it is possible to prevent the slurry from flowing between the coupling sleeve 30 and the pump shaft 21S (fitting member 41) through the gap G. As a result, the possibility of the wear occurring between the coupling sleeve 30 and the pump shaft 21S (fitting member 41) can be reduced.

(6) The crude oil extraction pump 100 according to a sixth aspect may further include the fitting member 41 that is fitted to each of the pair of pump shafts 21S, each of the pair of fitting members 41 is spline-fitted to the coupling sleeve 30 and thereby connected to a corresponding one of the pair of pump shafts 21S, and the crude oil extraction pump may further include the cover member 40 that is provided on the upper ends of the fitting member 41 and the coupling sleeve 30 to cover a gap therebetween.

According to the above-described configuration, the gap between the fitting member 41 and the coupling sleeve 30 is covered with the cover member 40 from above and the leakage is prevented by a seal (not shown) such as an oil seal. Thus, the possibility that the slurry flows into the gap can be reduced. As a result, the possibility of the wear occurring between the coupling sleeve 30 and the fitting member 41 can be reduced.

(7) In the crude oil extraction pump 100 according to a seventh aspect, the through-hole 80 may extend toward the rear side of the pump shaft 21S in the rotation direction R thereof as it goes from the inside to the outside in the radial direction.

According to the above-described configuration, the through-hole 80 extends toward the rear side of the pump shaft 21S in the rotation direction R (that is, the side opposite to the rotation direction R) as it goes from the inside to the outside in the radial direction. Thus, the possibility that the slurry flows into the through-hole 80 with the rotation of the pump shaft 21S can be reduced. As a result, the possibility of the wear occurring between the coupling sleeve 30 and the pump shaft 21S (fitting member 41) can be reduced.

(8) In the crude oil extraction pump 100 according to an eighth aspect, the pump stator 3 may include the intermediate thrust pad 8 protruding radially inward in the axis O from the inner peripheral surface P3 of the stator body 3H and supporting the thrust collar 6 from above to be slidable in the circumferential direction.

According to the above-described configuration, since the pump stator 3 is provided with the intermediate thrust pad 8 in addition to the intermediate thrust pad 7 which supports the thrust collar 6 from below, the thrust collar 6 is supported not only from below but also from above. Accordingly, fluctuations of the pump shaft 21S in the direction of the axis O can be suppressed.

REFERENCE SIGNS LIST

100 Crude oil extraction pump
1 Production pipe
1A Production pipe body
1B Production pipe tip
2 Rotor
21 Pump rotor
21S Pump shaft
210 Shaft outer peripheral surface
22 Motor rotor
22M Magnetic member
3 Pump stator
3B Stator shroud lower surface
3E Stator extension portion
3H Stator body
3S Stator shroud
30 Coupling sleeve
30*d* Lower end spline coupling
30*i* Sleeve inner peripheral surface
31 First protruding portion
32 Holder
32*a* Tubular portion
32*b* Flange portion
4 Support portion
40 Cover member
41 Fitting member
5 Impeller
51 Disk
51B Disk back surface
51M Disk main surface
52 Blade
53 Shroud cover
6 Thrust collar
61 Second protruding portion
6*d* Lower end thrust collar
6H Thrust collar body
7 Intermediate thrust pad (first thrust pad)
7*d* Lower end thrust pad
8 Intermediate thrust pad (second thrust pad)
9 Radial bearing
80 Through-hole
80*a* Inlet
80*b* Outlet
81 Capture portion
9 Drilling pipe
90 Partition portion
B Baffle plate
Bd Lower end thrust bearing portion
Bs Intermediate thrust bearing portion
Bh Balance hole
C Coil
D1 First stepped portion
D2 Second stepped portion
Fi Suction flow path
Fs Stator flow path
H Opening portion
M Motor
O Axis
P1 Facing surface
P2 Connection surface
P3 Downstream surface
Pt Protrusion portion
S1 First seal portion
S2 Second seal portion
V Vane
Ws Turning blade
Sc1, Sc2 Sliding surface

What is claimed is:

1. A crude oil extraction pump comprising:

a production pipe having a tubular shape along an axis extending in a vertical direction;

a pump rotor extending in a direction of the axis inside the production pipe; and a pump stator which is provided between the production pipe and the pump rotor to surround the pump rotor, wherein the pump rotor includes a plurality of pump shafts which are sequentially connected in the direction of the axis and a thrust collar which is provided in each pump shaft and protruding radially outward, wherein the pump stator includes a stator body having a tubular shape extending along the axis and a first thrust pad protruding radially inward in the axis from an inner peripheral surface of the stator body and supporting the thrust collar from below to be slidable in the circumferential direction, wherein the first thrust pad is disposed relative to the thrust collar of one of the plurality of pump shafts, wherein the pump stator includes a first protruding portion protruding upward to surround a sliding surface between the thrust collar and the first thrust pad from an outer peripheral side, and wherein the thrust collar includes a second protruding portion protruding radially outward and located above and facing an upper end of the first protruding portion in the vertical direction.

2. The crude oil extraction pump according to claim 1, wherein a pair of the pump shafts adjacent to each other in the vertical direction are arranged so that an upper end of one of the pump shafts is spaced apart from a lower end of the other, wherein a coupling sleeve is provided to connect the pair of adjacent pump shafts to cover an outer peripheral of the pump shafts, wherein the coupling sleeve is provided with a through-hole penetrating the coupling sleeve in the radial direction and opens to a gap between the pair of pump shafts, and wherein a capture portion for capturing slurry in the crude oil is provided in a part of the through-hole.

3. The crude oil extraction pump according to claim 2, further comprising:

a fitting member that is fitted to each of the pair of pump shafts, wherein each of a pair of fitting members is spline-fitted to the coupling sleeve and thereby connected to a corresponding one of the pair of pump shafts, and wherein the crude oil extraction pump further comprises a cover member that is provided on upper ends of the fitting member and the coupling sleeve to cover a gap therebetween.

4. The crude oil extraction pump according to claim 2, wherein the through-hole extends toward a rear side of the pump shaft in the rotation direction thereof as it goes from the inside to the outside in the radial direction.

5. A crude oil extraction pump comprising:

a production pipe having a tubular shape along an axis extending in a vertical direction;

a pump rotor extending in a direction of the axis inside the production pipe; and a pump stator which is provided between the production pipe and the pump rotor to surround the pump rotor, wherein the pump rotor includes a plurality of pump shafts which are sequentially connected in the direction of the axis and a thrust collar which is provided in each pump shaft and protruding radially outward, wherein the pump stator includes a stator body having a tubular shape extending along the axis and a first thrust pad protruding radially inward in the axis from an inner peripheral surface of the stator body and supporting the thrust collar from below to be slidable in the circumferential direction, wherein the first thrust pad is disposed relative to the thrust collar of one of the plurality of pump shafts, wherein a pair of the pump shafts adjacent to each other in the vertical direction are arranged so that an upper end of one of the pump shafts is spaced apart from a lower end of the other, wherein a coupling sleeve is provided to connect the pair of adjacent pump shafts to cover an outer peripheral of the pump shafts, wherein the coupling sleeve is provided with a through-hole penetrating the coupling sleeve in the radial direction and opens to a gap between the pair of pump shafts, and wherein a capture portion for capturing slurry in the crude oil is provided in a part of the through-hole, wherein the crude oil extraction pump further comprises a fitting member that is fitted to each of the pair of pump shafts, wherein each of a pair of fitting members is spline-fitted to the coupling sleeve and thereby connected to a corresponding one of the pair of pump shafts, and wherein the crude oil extraction pump further comprises a cover member that is provided on upper ends of the fitting member and the coupling sleeve to cover a gap therebetween.

6. The crude oil extraction pump according to claim 5, wherein the through-hole extends toward a rear side of the pump shaft in the rotation direction thereof as it goes from the inside to the outside in the radial direction.

* * * * *